US005897035A

United States Patent [19]

Schlömer

[11] Patent Number: 5,897,035

[45] Date of Patent: Apr. 27, 1999

[54] FLUID CONTAINER FOR SHIPPING AND STORING FLUIDS

[75] Inventor: Gert-Peter Schlömer, Cologne, Germany

[73] Assignee: Felix Bottcher GmbH & Co., Cologne, Germany

[21] Appl. No.: 08/966,856

[22] Filed: Nov. 10, 1997

[30] Foreign Application Priority Data

Feb. 13, 1997 [EP] European Pat. Off. ..... 97102317

[51] Int. Cl.[6] ..... B67D 3/00

[52] U.S. Cl. ..... 222/479

[58] Field of Search ..... 222/468, 479

[56] References Cited

U.S. PATENT DOCUMENTS

| | | | |
|---|---|---|---|
| 819,191 | 5/1906 | Weeks | 222/468 |
| 4,412,633 | 11/1983 | Guerrazzi et al. | 222/468 |

FOREIGN PATENT DOCUMENTS

| | | |
|---|---|---|
| 661164 | 7/1965 | Belgium . |
| 058624 | 8/1982 | European Pat. Off. . |
| 2675771 | 10/1992 | France . |
| 9004463 | 9/1990 | Germany . |
| 1042998 | of 1966 | United Kingdom . |

*Primary Examiner*—Gregory L. Huson

*Attorney, Agent, or Firm*—Jacobson, Price, Holman & Stern, PLLC

[57] ABSTRACT

The fluid container for shipping and storing fluids, especially liquid detergents for the printing trade, consists of an approximately rectangular recipient having rounded corners, a screw cap, an aerator pipe leading to the interior of the container, and a carrying handle situated at the upper part of the container, the interior of which has a hollow design, the handle at the same time serving as the aerator pipe.

3 Claims, 1 Drawing Sheet

FLUID CONTAINER FOR SHIPPING AND STORING FLUIDS

The present invention pertains to a fluid container for shipping and storing fluids, especially liquid detergents for the printing trade, consisting of an approximately rectangular recipient having rounded corners, a screw cap, an aerator pipe leading to the interior of the container, and a carrying handle situated at the upper part of the container.

Such fluid containers are known and have proven useful in practice. If such fluid containers have no aerator pipe leading to the interior of the container, they tend to "gurgle" when emptied and thus to be emptied in a non-uniform and hardly controllable way.

The incorporation of aerator pipes involves substantial expenditure, which applies equally to both metal containers and plastic containers.

It has been the object of the invention to develop a fluid container which has an aerator pipe leading to the interior of the container and yet can be easily prepared.

This object can be achieved in a surprisingly simple manner by the interior of the carrying handle having a hollow design wherein the handle at the same time serves as the aerator pipe. This is preferably accomplished by one end of the carrying handle with the hollow design communicating with the interior of the container and the other end being designed beyond the site of attachment of the handle to the container as an open line which ends in the interior of the screw cap.

Containers having reinforcing ribs at the site of attachment of the handle to the container have already proven succesful in practice.

In order that the fluid containers according to the invention may be easily and safely stacked, their bottoms preferably have recesses to accommodate the carrying handle and the reinforcing ribs, if any. If the screw cap should also be designed so high that it would interfere with the bottom of the next container when the containers are stacked, the corresponding portion of the bottom can also be designed in a recessed way.

Such a fluid container which can be readily stacked has already been known from Applicant's German utility model 89 09 327.5. However, a drawback of this known container is that it lacks an aerator pipe leading to the interior of the container. Attempts to incorporate such an aerator pipe in the interior of the container and to fasten it solidly to the container have failed.

A typical embodiment of the fluid container according to the invention is illustrated in more detail in the accompanying FIGS. 1 and 2.

Figure 1:
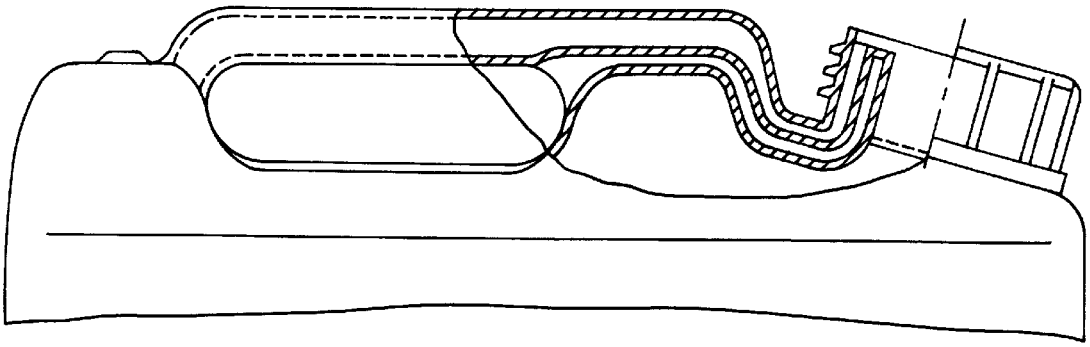
FIG. 1 shows the upper part of the fluid container according to the invention in an elevational view, and in addition, in a sectional view, the continuation of the interior of the carrying handle with the hollow design into the screw cap.
Figure 2:
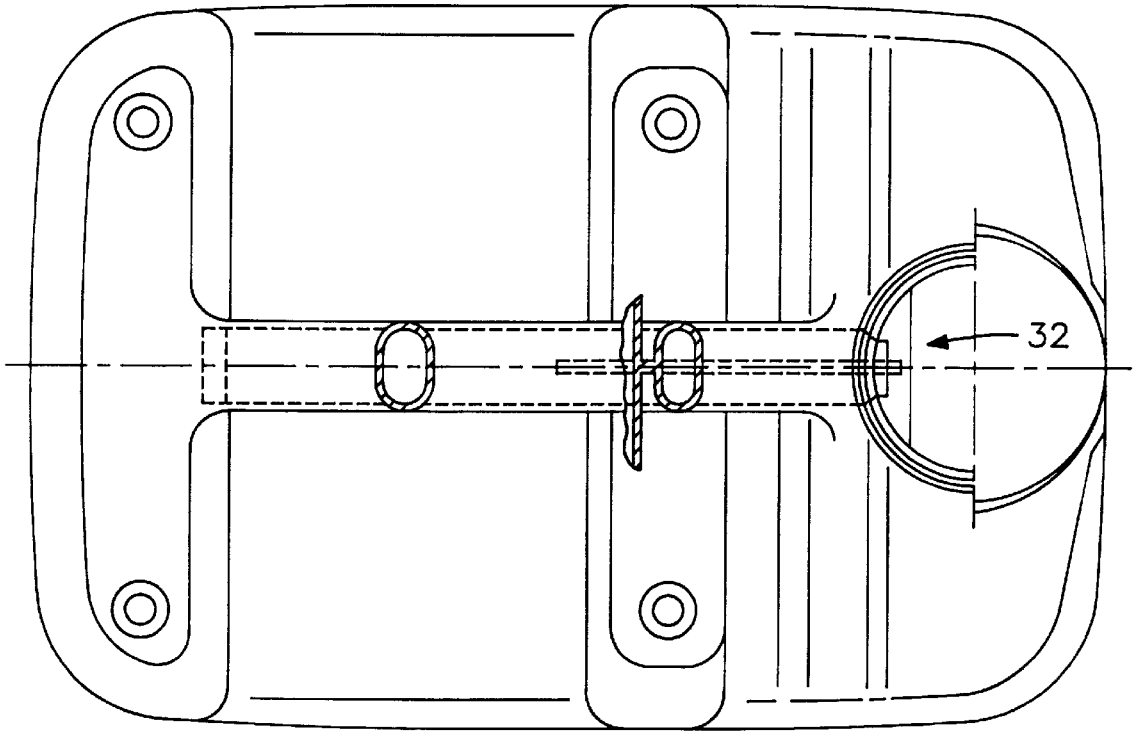
FIG. 2 shows the container according to the invention in a top plan view, showing the carrying handle and its attachment on a reinforcing rib.

Further, both figures show the screw cap which is represented in each figure with one half thereof showing the cap and one half thereof with the cap removed.

What is claimed is:

1. A fluid container for shipping and storing fluids, especially liquid detergents for the printing trade, comprised of an approximately rectangular recipient having rounded corners, a screw cap, an aerator pipe leading to the interior of the container, and a carrying handle situated at the upper part of the container, characterized in that (i) the interior of said carrying handle has a hollow design, the handle at the same time serving as the aerator pipe.(ii) one end of the carrying handle with the hollow design communicates with the interior of the container and the other end is designed beyond the site of attachment of the handle to the container as an open line which ends in the interior of the screw cap, (iii) the sites of attachment of the handle to the container have reinforcing ribs, and (iv) the bottom of said container has recesses to accommodate the carrying handle and the reinforcing ribs, when several containers are stacked on top of one another.

2. A fluid container for shipping and storing fluids, especially liquid detergents for the printing trade, comprised of an approximately rectangular recipient having rounded corners, a screw cap, an aerator pipe leading to the interior of the container, and a carrying handle situated at the upper part of the container, characterized in that the interior of said carrying handle has a hollow design, the handle at the same time serving as the aerator pipe, and the sites of attachment of the handle to the container have reinforcing ribs.

3. A fluid container for shipping and storing fluids, especially liquid detergents for the printing trade, comprised of an approximately rectangular recipient having rounded corners, a screw cap, an aerator pipe leading to the interior of the container, and a carrying handle situated at the upper part of the container, characterized in that the interior of said carrying handle has a hollow design, the handle at the same time serving as the aerator pipe, one end of the carrying handle with the hollow design communicates with the interior of the container and the other end is designed beyond the site of attachment of the handle to the container as an open line which ends in the interior of the screw cap, and the sites of attachment of the handle to the container have reinforcing ribs.

* * * * *